US009426555B2

(12) United States Patent
Yamamoto

(10) Patent No.: US 9,426,555 B2
(45) Date of Patent: Aug. 23, 2016

(54) ACOUSTICALLY TUNABLE HEADPHONES

(71) Applicant: Ever Win International Corporation, City of Industry, CA (US)

(72) Inventor: Yasuhiro Yamamoto, Los Angeles, CA (US)

(73) Assignee: Ever Win International Corporation, City of Industry, CA (US)

( * ) Notice: Subject to any disclaimer, the term of this patent is extended or adjusted under 35 U.S.C. 154(b) by 0 days.

(21) Appl. No.: 14/580,587

(22) Filed: Dec. 23, 2014

(65) Prior Publication Data

US 2016/0182990 A1 Jun. 23, 2016

(51) Int. Cl.
*H04R 25/00* (2006.01)
*H04R 1/10* (2006.01)

(52) U.S. Cl.
CPC ..... *H04R 1/10* (2013.01)

(58) Field of Classification Search
CPC ..... H04R 1/10; H04R 1/1008; H04R 1/1058; H04R 1/1091; H04R 2205/022
See application file for complete search history.

(56) References Cited

U.S. PATENT DOCUMENTS 1,915,358 A 6/1933 Giles
2,022,060 A 11/1935 Swickard
2,645,301 A 7/1953 De Vries
3,952,435 A 4/1976 Olsen
3,999,020 A 12/1976 Bastiaans et al.
4,027,116 A 5/1977 Nakamura
4,785,562 A 11/1988 Good
5,729,605 A 3/1998 Bobisuthi et al.
6,658,121 B1 12/2003 Konig
7,316,290 B2 1/2008 Hutt et al.
7,543,681 B2 6/2009 Howard et al.
7,582,828 B2 9/2009 Ryan
7,856,114 B2 12/2010 Belanger et al.
8,295,531 B2 10/2012 Lin
8,953,815 B2 * 2/2015 Shinozaki ..... H04R 1/1091 381/384
2006/0104471 A1 5/2006 Tsunoda et al.
2011/0051975 A1 3/2011 Lee
2013/0177165 A1 * 7/2013 Oishi ..... H04R 1/1041 381/74
2015/0222980 A1 * 8/2015 Pizzaro ..... H04R 1/1058 381/371

* cited by examiner

*Primary Examiner* — Tuan D Nguyen
(74) *Attorney, Agent, or Firm* — Joe Nieh

(57) ABSTRACT

The acoustically tunable headphones comprises of a flexible headband with a speaker housing affixed on either end of the flexible headband. The speaker housing encloses one or more speakers behind a grill with multiple openings. A soft and flexible ear pad is removably affixed in front of the grill. A corresponding grill with corresponding openings is affixed in the ear pad. By rotating the ear pad to various positions and repositioning the grills openings, the acoustics of the headphones may be adjusted.

20 Claims, 6 Drawing Sheets

ACOUSTICALLY TUNABLE HEADPHONES

BACKGROUND

1. Field of Invention

This invention relates generally to headphones. More specifically, this invention relates to headphones that can be tuned acoustically by the user.

2. Description of Related Art

Headphones are commonly used to listen to audio signals such as voice communications, audio recordings, and music. Headphones generally comprises of a flexible headband that is placed over the head of a listener. On either sides of the flexible headband is affixed a speaker housing enclosing one or more speakers. The speaker housing commonly has a soft and flexible ear pad which enables the speaker housing to comfortably rest on or around the listener's ear. The flexible headband exerts a force that urges the speaker housings to press against the ear pads which in turn presses on or around the ear of the listener to seal out the outside environment from the ear.

Most headphone's acoustics are predetermined and fixed when the headphone was designed and manufactured. The user may generally vary the audio signal electronically by using a separate equalizer or other electronic adjustments to vary the various high and low frequencies. However, the acoustics of the headphones itself is generally not adjustable by the user.

There are some headphone designs that include complex and costly components to enable the user to adjust the frequency response of the headphones. These headphone designs use many small, complex, and movable components in their design to allow the user to vary the frequency response of the headphones. Although they are suitable for the purpose for which they were designed, they are expensive to manufacture and the complexity of the design also decrease the reliability of the headphones. The cost of these headphones and also the complexity of their design contributed to their lack of demand and the lack of popularity in the market.

BRIEF SUMMARY OF THE INVENTION

The present invention is an acoustically tunable headphones that is simple in construction and economical to manufacture. It allows the user of the headphones to easily adjust the acoustics of the headphones mechanically without the use of any complex and expensive electronics.

The acoustically tunable headphones comprises of a flexible headband with a speaker housing affixed on either end of the flexible headband. The speaker housing encloses one or more speakers behind a speaker grill with multiple openings. A soft and flexible ear pad is removably affixed in front of the speaker grill. A corresponding grill with corresponding openings is affixed in the ear pad. The acoustics of the headphones may be adjusted by rotating the ear pad to various positions which will place the multiple openings in the speaker grill in front of the speakers in various communications with the multiple openings in the grill in the ear pad.

It is an object of the present invention to design an acoustically tunable headphones with no additional electronics and no internal moving parts that is easily manufactured with minimal cost impact.

It is another object of the present invention to design an acoustically tunable headphones that may be easily adjusted by the user to change the acoustics of the headphones.

It is yet another object of the present invention to design an acoustically tunable headphones that has easily removable and replaceable ear pads that may be interchanged with other optional ear pads to enable further acoustical tuning of the headphones.

DETAILED DESCRIPTION OF THE PREFERRED EMBODIMENT

The following description and figures are meant to be illustrative only and not limiting. Other embodiments of this invention will be apparent to those of ordinary skill in the art in view of this description.

Figure 1:
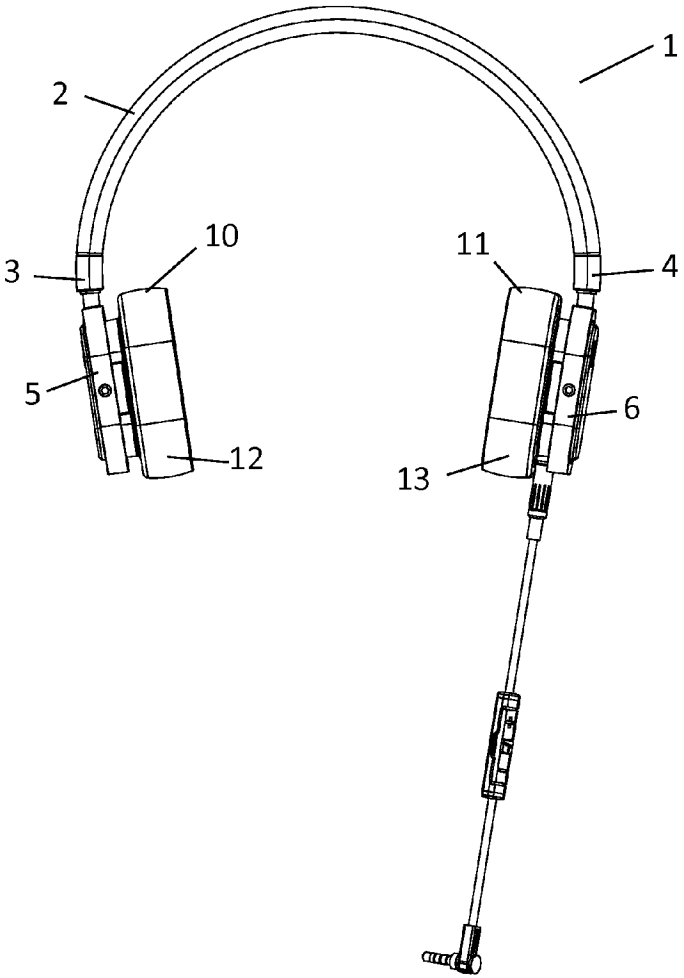
FIG. 1 shows a front plan view of the acoustically tunable headphones.
Figure 2:
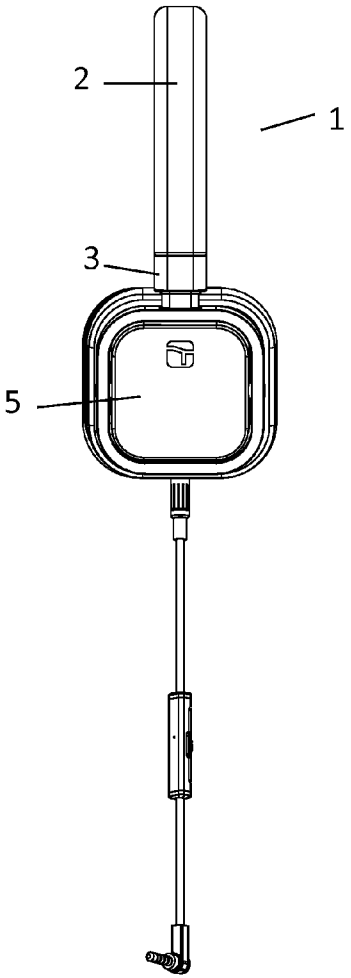
FIG. 2 shows a left side plan view of the acoustically tunable headphones.
Figure 3:
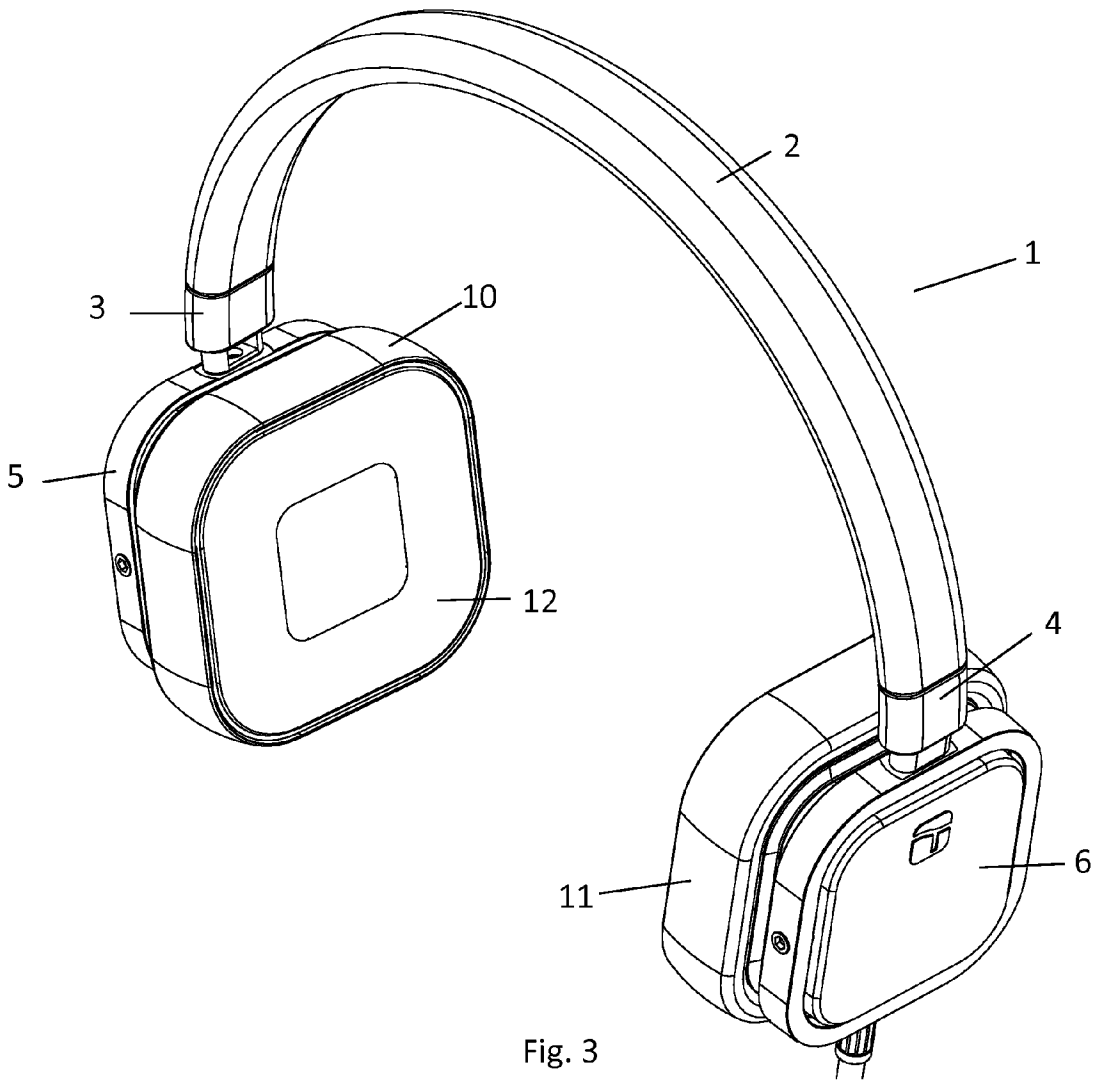
FIG. 3 shows a perspective view of the acoustically tunable headphones.
Figure 4:
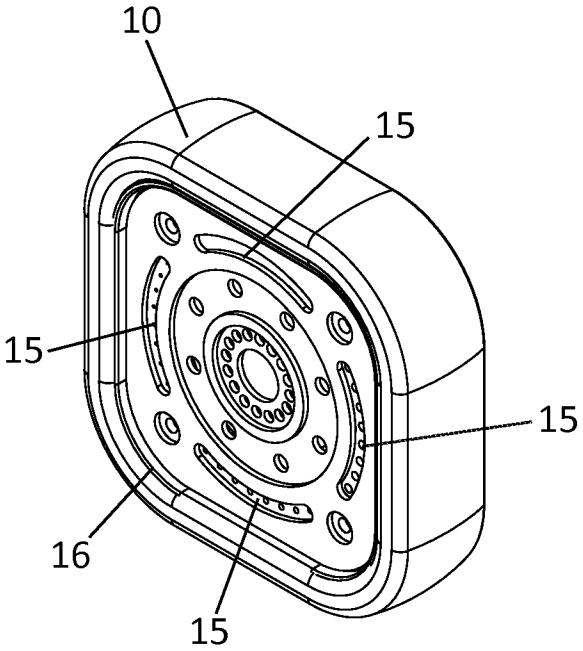
FIG. 4 shows a perspective rear view of the preferred embodiment of the ear pad.
Figure 5:
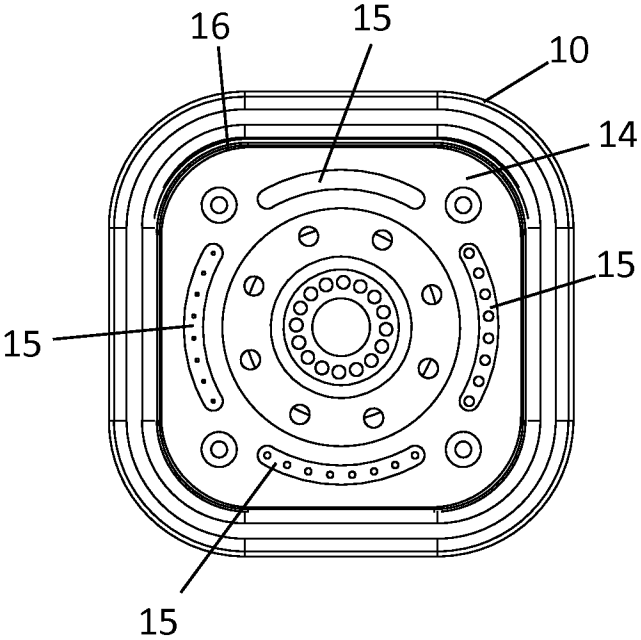
FIG. 5 shows a rear plan view of the preferred embodiment of the ear pad shown in FIG. 4.
Figure 6:
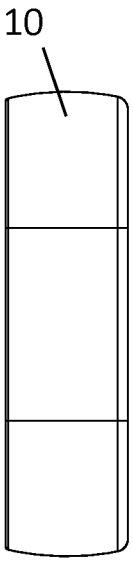
FIG. 6 shows a side plan view of the preferred embodiment of the ear pad shown in FIG. 4.
Figure 7:
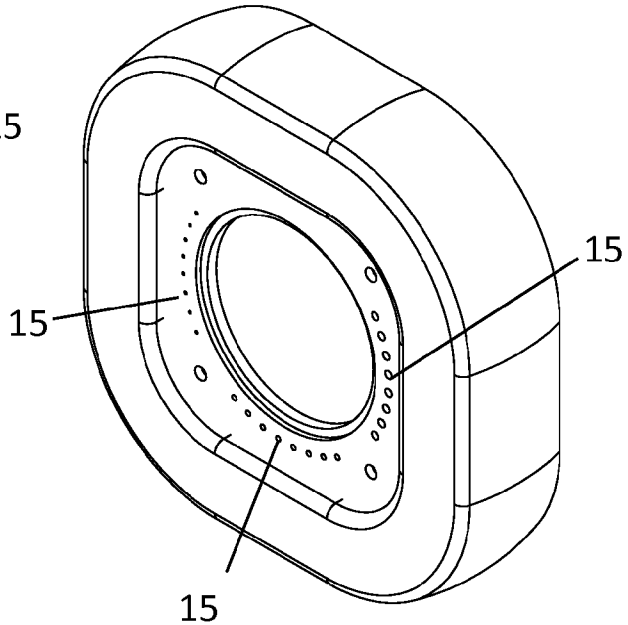
FIG. 7 shows a perspective rear view of another embodiment of the ear pad.
Figure 8:
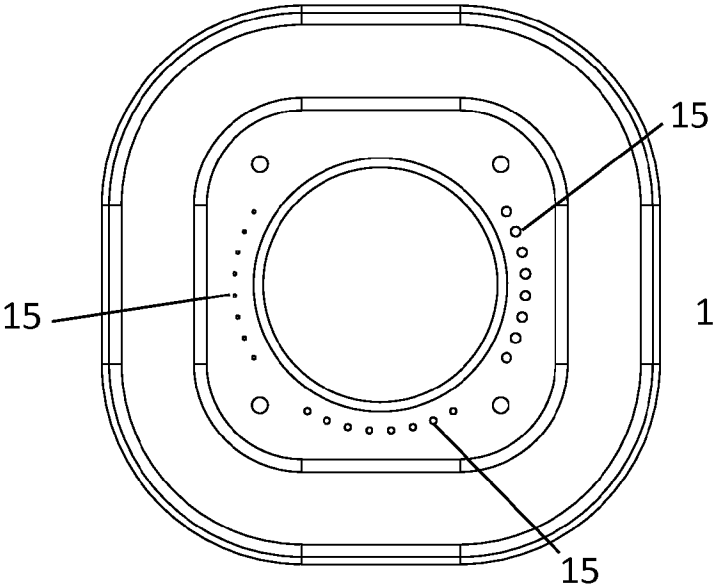
FIG. 8 shows a rear plan view of the embodiment of the ear pad shown in FIG. 7.
Figure 9:
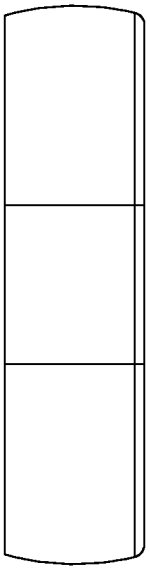
FIG. 9 shows a side plan view of the embodiment of the ear pad shown in FIG. 7.
Figure 10:
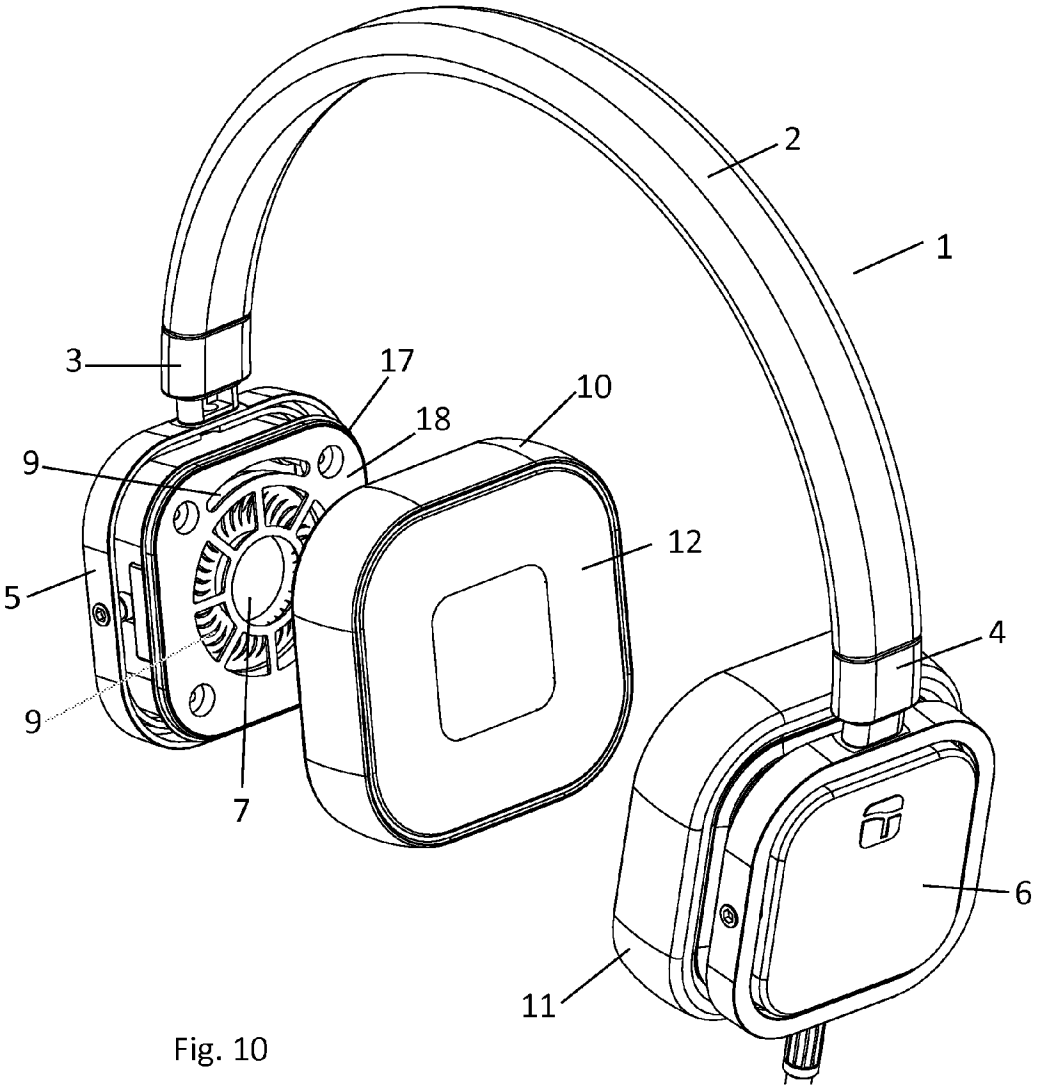
FIG. 10 shows a partially exploded perspective view of the preferred embodiment of the acoustically tunable headphones.
Figure 11:
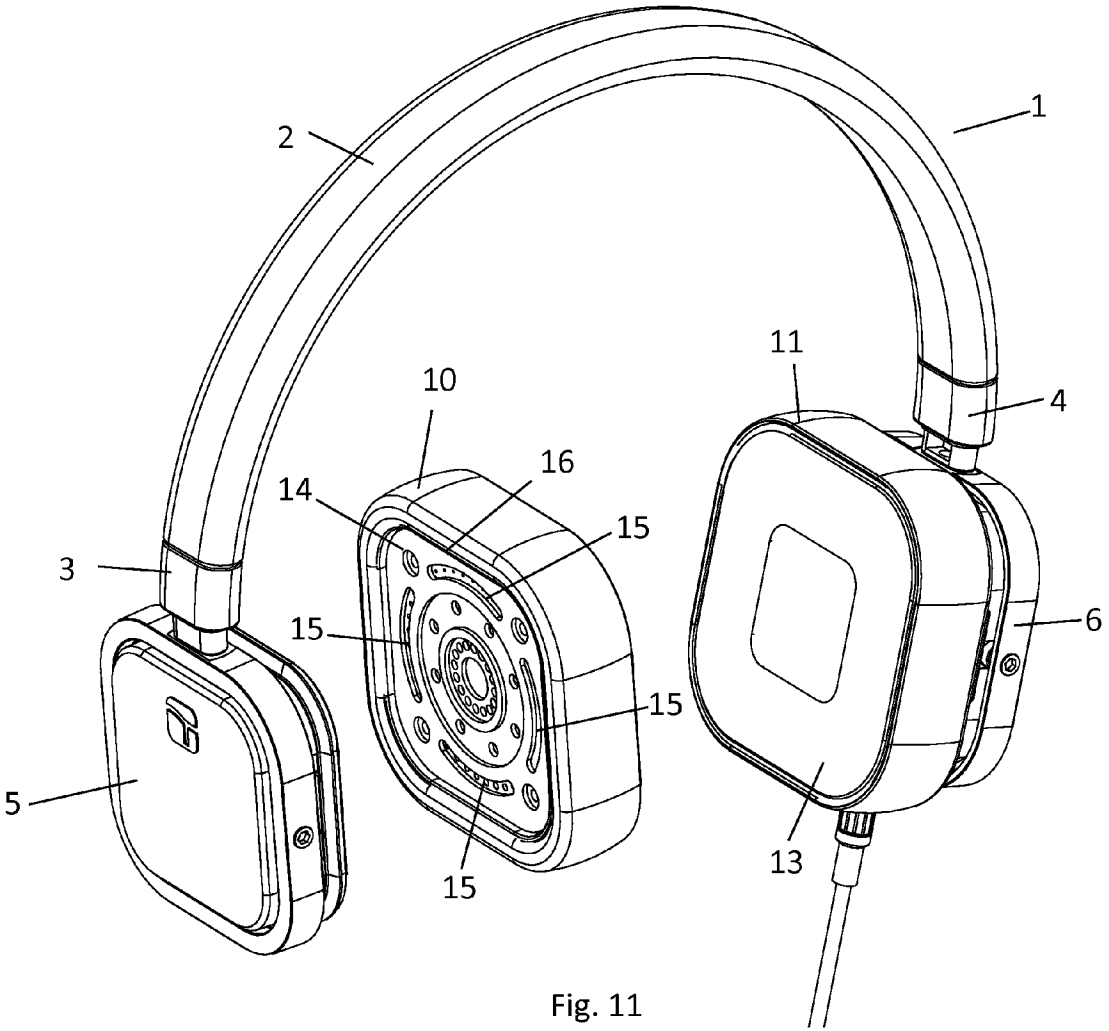
FIG. 11 shows another partially exploded perspective view of the preferred embodiment of the acoustically tunable headphones shown in FIG. 10.

Referring to FIGS. 1, 2, 3, 10, and 11, in the preferred embodiment, the acoustically tunable headphones 1 comprises of a flexible headband 2 with two ends 3, 4. The flexible headband 2 may be made of an elastic metallic material, an elastic polymer, or a combination of them. A speaker housing 5, 6 is affixed on either end 3, 4 of the flexible headband 2. The speaker housing 5, 6 may be made of a metallic material, a polymer, or a combination of them. As seen in FIG. 10, each speaker housing 5, 6 encloses one or more speakers 7 behind a speaker grill 18 with multiple openings 9. The multiple openings 9 are generally arranged in subgroups of various number of openings and various sizes of openings around the center of the speaker grill 18.

An ear pad 10, 11 with a soft and flexible padding and sealing material 12, 13 on one side around its circumference is removably affixed in front of the speaker grill 18. The ear pad 10, 11 may be made of a metallic material, a polymer, or a combination of them. The soft and flexible padding and sealing material 12, 13 may be made of a foam, a polymer or leather covered foam, silicone, or any other suitable soft and flexible material that is comfortable when place in contact with the user's ear. As further shown in FIGS. 4, 5, 6, 7, 8, and 9, a corresponding grill 14 with corresponding openings 15 to the speaker grill 18 in front of the speakers 7 is affixed in the ear pad 10, 11 opposite the side with the padding material 12, 13. The openings 15 are generally arranged in subgroups of various number of openings and various sizes of openings around the center of the grill 14 and may be rotated into or out of alignment with the multiple openings 9 in the speaker grill 18 in front of the speakers 7. The ear pad 10, 11 is preferably removably attached to the speaker housing 5, 6 with one or more magnets. In the preferred embodiment, the ear pad 10, 11 has one or more permanent magnets affixed around the grill 14. The speaker grill 18 in front of the speakers 7 is made of a magnetically attractive material such as steel for the magnets to attract to. Alternatively, the placement of the magnet and the magnetically attractive material may be reversed, wherein the grill 14 in the ear pad 10, 11 is made of a magnetically attractive material and one or more permanent magnets is affixed around the speaker grill 18 in front of the speakers 7.

In the preferred embodiment, ridges 16 may be formed on the face with the grill 14 of the ear pad 10, 11 and corresponding valleys 17 may be formed on the speaker grill 18 in front of the speakers 7 to position the ear pad 10, 11 in a limited number of predetermined positions. Alternatively, the ridges may be formed on the speaker grill 18 in front of the speakers 7 and the valleys may be formed on the face with the grill 14 of the ear pad 10, 11.

In the preferred embodiment, the ear pads 10, 11 and the speaker grills 18 in front of the speakers 7 are generally square shape with rounded corners, as shown in FIGS. 4, 5, 6, 7, 8, and 9. The square shape allows four possible positions of the ear pad 10, 11 on the speaker grills 18 in front of the speakers 7, therefore, four possible acoustic tunings from different combinations of the openings. Alternatively, the ear pads and grills may be elliptical or rectangular shape. This will allow two possible positions and, therefore, two possible acoustic tunings. Another embodiment may use round shape ear pads and grills to allow virtually infinite variations in acoustic tunings Preferably, for round shape ear pads and grills, alignment pins or other known rotation system with detent is used to limit the free rotation of the ear pads and maintain its position after adjustment.

The acoustics of the headphones 1 may be adjusted by rotating the ear pad 10, 11 to various positions which will place the multiple openings 9 in the speaker grill 18 in front of the speakers 7 in various communications with the multiple openings 15 in the grill 14 in the ear pad 10, 11. The user may adjust the acoustics to his or her preference and to match the type of audio that is being reproduced by the headphones 1.

The acoustically tunable headphones 1 with its easily removable and replaceable ear pads 10, 11 also enables the designer and manufacturer to design and manufacture other replaceable ear pads made of different padding materials and/or with different number and size of openings to enable further acoustical tuning of the headphones and to meet the preference of the user. The user may simply purchase the optional replacement ear pads and change the ear pads easily without any tools to customize it to their preference.

Although the invention has been described in terms of particular embodiments and applications, one of ordinary skill in the art, in light of this teaching, can generate additional embodiments and modifications without departing from the spirit of or exceeding the scope of the claimed invention. Accordingly, it is to be understood that the drawings and descriptions herein are proffered by way of example to facilitate comprehension of the invention and should not be construed to limit the scope thereof.

What is claimed is:

1. An acoustically tunable headphone comprising:
a flexible headband with two ends;
a speaker housing affixed on either end of the flexible headband;
one or more speakers are enclosed in each speaker housing;
a speaker grill with multiple openings is affixed over the speakers;
a removable ear pad removably affixed in front of the speaker grill and is rotatable and reattachable in front of the speaker grill in different positions;
a grill with corresponding multiple openings to the speaker grill affixed in the ear pad;
wherein the acoustics of the headphones may be adjusted by rotating the removable ear pad to various positions which will place the multiple openings in the speaker grill in various communications with the multiple openings in the grill in the ear pad.

2. An acoustically tunable headphone as in claim 1, wherein the flexible headband is made of an elastic metallic material, an elastic polymer, or a combination of them.

3. An acoustically tunable headphone as in claim 1, wherein the speaker housing is made of a metallic material, a polymer, or a combination of them.

4. An acoustically tunable headphone as in claim 1, wherein the multiple openings are generally arranged in subgroups of various number of openings and various sizes of openings around the center of the speaker grill.

5. An acoustically tunable headphone as in claim 1, wherein the ear pad has a soft and flexible padding and sealing material on one side around its circumference.

6. An acoustically tunable headphone as in claim 5, wherein the soft and flexible padding and sealing material is made of a foam, a polymer or leather covered foam, or silicone.

7. An acoustically tunable headphone as in claim 1, wherein the ear pad is made of a metallic material, a polymer, or a combination of them.

8. An acoustically tunable headphone as in claim 1, wherein the ear pad is preferably removably attached to the speaker housing with one or more magnets.

9. An acoustically tunable headphone as in claim 8, wherein the ear pad has one or more magnets affixed around the grill and the speaker grill is made of a magnetically attractive material.

10. An acoustically tunable headphone as in claim 8, wherein the grill in the ear pad is made of a magnetically attractive material and one or more magnets is affixed to the speaker grill.

11. An acoustically tunable headphone as in claim 8, wherein ridges are formed on the face of the grill of the ear pad and corresponding valleys are formed on the speaker grill to position the ear pad in a limited number of predetermined positions.

12. An acoustically tunable headphone as in claim 8, wherein ridges are formed on the speaker grill and corresponding valleys are formed on the face of the grill of the ear pad to position the ear pad in a limited number of predetermined positions.

13. An acoustically tunable headphone as in claim 1, wherein the ear pads are generally square shape with rounded corners.

14. An acoustically tunable headphone as in claim 1, wherein the ear pads are round, elliptical, or rectangular shape.

15. An acoustically tunable headphone comprising:
a flexible headband with two ends;
a speaker housing affixed on either end of the flexible headband;
one or more speakers are enclosed in each speaker housing;
a speaker grill with multiple openings wherein the multiple openings are generally arranged in subgroups of various number of openings and various sizes of openings around the center of the speaker grill is affixed over the speakers;

a removable ear pad with a soft and flexible padding and sealing material on one side around its circumference is removably affixed in front of the speaker grill and is rotatable and reattachable in front of the speaker grill in different positions;

a grill with corresponding multiple openings to the speaker grill affixed in the ear pad;

wherein the acoustics of the headphones may be adjusted by rotating the removable ear pad to various positions which will place the multiple openings in the speaker grill in various communications with the multiple openings in the grill in the ear pad.

16. An acoustically tunable headphone as in claim 15, wherein the ear pad is preferably removably attached to the speaker housing with one or more magnets.

17. An acoustically tunable headphone as in claim 15, wherein ridges are formed on the face of the grill of the ear pad and corresponding valleys are formed on the speaker grill to position the ear pad in a limited number of predetermined positions.

18. An acoustically tunable headphone as in claim 15, wherein ridges are formed on the speaker grill and corresponding valleys are formed on the face of the grill of the ear pad to position the ear pad in a limited number of predetermined positions.

19. An acoustically tunable headphone as in claim 15, wherein the ear pads are generally square shape with rounded corners.

20. An acoustically tunable headphone as in claim 15, wherein the ear pads are round, elliptical, or rectangular shape.

* * * * *